US008375597B2

(12) United States Patent
Ahn et al.

(10) Patent No.: US 8,375,597 B2
(45) Date of Patent: Feb. 19, 2013

(54) DRYER AND FOREIGN MATERIAL REMOVING APPARATUS THEREOF

(75) Inventors: Seung Phyo Ahn, Changwon (KR); Jeong Yun Kim, Changwon (KR); Sang Ik Lee, Changwon (KR)

(73) Assignee: LG Electronics Inc., Seoul (KR)

( * ) Notice: Subject to any disclaimer, the term of this patent is extended or adjusted under 35 U.S.C. 154(b) by 455 days.

(21) Appl. No.: 12/640,163

(22) Filed: Dec. 17, 2009

(65) Prior Publication Data

US 2010/0146803 A1 Jun. 17, 2010

(30) Foreign Application Priority Data

Dec. 17, 2008 (KR) ..... 10-2008-0128601

(51) Int. Cl.
*F26B 21/06* (2006.01)
*F26B 11/02* (2006.01)

(52) U.S. Cl. ..... 34/82; 34/604; 34/140

(58) Field of Classification Search ..... 34/72, 79, 34/82, 130, 140, 604
See application file for complete search history.

(56) References Cited

U.S. PATENT DOCUMENTS

| | | | | |
|---|---|---|---|---|
| 3,378,934 | A | 4/1968 | Erickson | 34/82 |
| 5,968,217 | A * | 10/1999 | Stein et al. | 55/496 |
| 7,257,905 | B2 * | 8/2007 | Guinibert et al. | 34/82 |

FOREIGN PATENT DOCUMENTS

| | | | |
|---|---|---|---|
| CN | 101311407 | A | 11/2008 |
| DE | 84 37 357 | U1 | 3/1985 |
| KR | 10-0452370 | B1 | 10/2004 |
| KR | 10-0664507 | B1 | 1/2007 |

OTHER PUBLICATIONS

Chinese Office Action dated May 11, 2011 issued in Application No. 200910253772.5 (with translation).

* cited by examiner

*Primary Examiner* — Jiping Lu
(74) *Attorney, Agent, or Firm* — Ked & Associates LLP

(57) ABSTRACT

A dryer and a foreign material removing apparatus thereof are provided. The dryer and the foreign material removing apparatus can clearly remove foreign materials adhered to a filter using only a simple operation without the user effort.

20 Claims, 10 Drawing Sheets

DRYER AND FOREIGN MATERIAL REMOVING APPARATUS THEREOF

BACKGROUND OF THE INVENTION

1. Field of the Invention

The embodiment relates to a dryer and a foreign material removing apparatus thereof.

2. Description of the Related Art

In general, a dryer is an apparatus that dries a dry target by blowing hot wind generated by a heater into a rotary drum to absorb moisture of a drying target (i.e., clothes which has been washed).

The dryer is largely classified into an exhaust type dryer and a condensation type dryer in accordance with a processing scheme of wet air containing moisture generated by drying the drying target. More specifically, the exhaust-type dryer uses a scheme that discharges the wet air discharged from the drum to the outside of the dryer, while the condensation-type dryer use a re-circulation scheme that removes the moisture by condensing the wet air discharged from the drum in a heat-exchanger and thereafter, heats a dry air without moisture again and sends it to the drum.

Meanwhile, since the drum is formed in a rotation type, the drying target housed in the drum shakes in the drum as the drum rotates. In this process, foreign materials contained in the drying target are spread in the air. That is, the foreign materials are included in the air passing through the drum.

The foreign materials contained in the air causes troubles while passing through mechanical components of the dryer. In addition, the foreign materials contained in the air are discharged to the outside of the dryer to injure user's health. Therefore, while the air passing through the drum passes through a filter, the foreign materials should be removed from the air.

In general, the filter is provided at the front portion of the drum and filters the foreign materials contained in the air passing through the drum. When the foreign materials are accumulated in the filter at predetermined levels, circulation of the air is interfered, such that cleaning is required. In general, the filter is removably coupled to the dryer and after a drying cycle is terminated, the user separates and cleans the filter.

In particular, since the foreign materials which are contained in the wet air contain moisture, the foreign materials are damply attached to the filter. In addition, as the drying cycle is performed, when the amount of the moisture contained in the air decreases, the damply wet foreign materials adhere to the filter while being dried.

According to the dryer in the related art, in order to clean the filter to which the foreign materials is adhered, there is a problem in that the cleaning should be by the user effort, such as strongly shaking off the filter.

If the state where the foreign materials adhere to the filter is ignored, proper wind quantity is not secured. As a result, since the air heated by the heater is not cooled, there is a risk of fire.

In addition, since the filter cleaning operation should be performed whenever using the dry in order to secure the wind quantity in the dryer and prevent firing, it is troublesome to the user.

SUMMARY OF THE INVENTION

The embodiment proposes to solve the above-mentioned problems. An object of the present invention is to provide a dryer including a filter to more facilitate cleaning and a foreign material removing apparatus thereof.

In addition, another object of the present invention is to provide a dryer that automatically clean a filter without manually cleaning the filter and allows the user to separate and discharge the foreign materials removed from the filter and a foreign material removing apparatus thereof.

Further, yet another object of the present invention is to provide a dryer that maintains wind quantity at a predetermined level to improve drying performance without a risk of firing and a foreign material removing apparatus.

In order to achieve the above objects, a dryer according to an embodiment of the present invention includes: a cabinet that forms an exterior; a drum that is provided in the cabinet and houses a drying target; a base that has a rotation motor rotating the drum and a blowing fan moving air in the drum; a drum cover that is coupled to the base and supports the drum; a case in which an air introduction hole that is mounted on the drum cover and into which air discharged from the drum is introduced and an air discharge hole that discharges air without foreign materials are formed; and a filtering unit that is separately mounted on the case and filters the foreign materials in the introduced through the introduction hole, wherein the filtering unit includes a filter member in which a plurality of parts folded based on the curved portion are provided.

A foreign material removing apparatus of a dryer according to another embodiment includes: a case that includes an air introduction hole into which air discharged from a drum is introduced and an air discharge hole that discharges air introduced through the air introduction hole from which foreign materials are separated; a filter member that is mounted on the case to filter the foreign materials from air and is provided with a plurality of parts; a curved portion that connects the plurality of parts and can relatively rotate the plurality of parts; and a guide part that extends along at least one side of the filter member and guides the rotation of the plurality of parts.

A dryer according to yet another embodiment of the present invention includes: a drum that houses a drying target; a base that includes a rotation motor that is provided on one side of the drum and rotates the drum and has a blowing fan that moves air; a foreign material removing apparatus that filters foreign materials from air moved by the operation of the blowing fan and cleans the filtered foreign materials; and a foreign material case that is provided on one side of the foreign material removing apparatus and stores the foreign materials cleaned in the foreign material removing apparatus, wherein the foreign material removing apparatus includes a filter member that separates the foreign materials from air and perform a folding movement; a filter case that movably supports the filter member; and a guide groove that is provided on one side of the filter case and guides the folding movement of the filter member.

With the dryer and the foreign material removing apparatus according to the present invention, it can clearly remove the foreign materials adhered to the filter only by the simple operation without using the user effort.

In addition, the filter is provided in a folded type and is automatically operated by the driving unit, thereby making it possible to effectively remove the foreign materials adhered to the filter. Therefore, the product image is luxurious and the satisfaction of user is increased.

Moreover, the convenience of user can be maximized by separating and cleaning only the case when the foreign materials are stored in the case above a predetermined amount without the user needing to clean the filter each time the dryer is used.

Further, since the wind quantity passing through the inside of the drum is secured at a predetermined level or more while the filter is automatically cleaned, there is no risk of firing.

DETAILED DESCRIPTION OF THE PREFERRED EMBODIMENTS

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
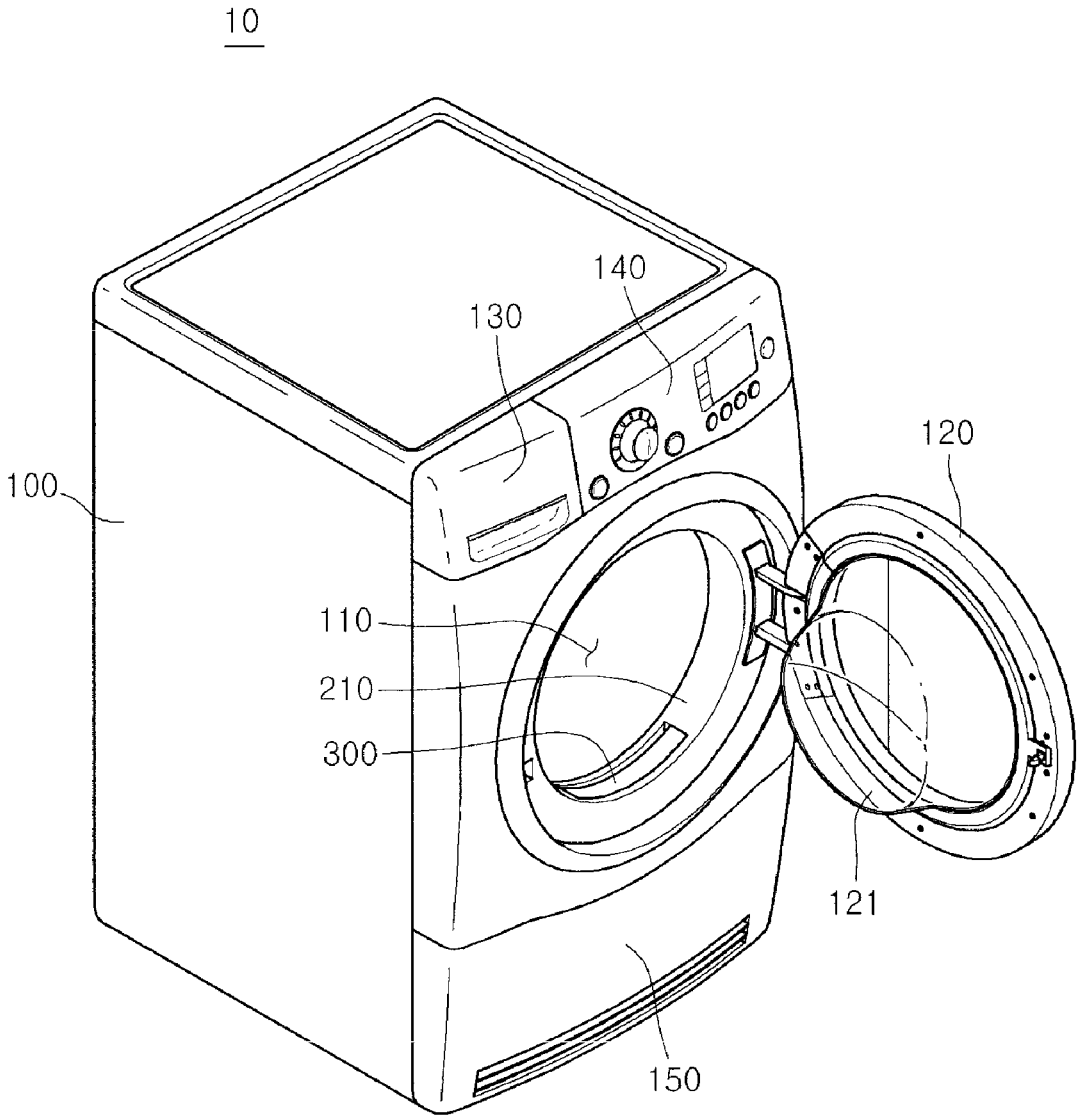
FIG. 1 is a perspective view showing an exterior of a dryer according to the embodiment of the present invention.

FIG. 1 is a perspective view showing an exterior of a dryer according to a first embodiment of the present invention.

Hereinafter, a condensation-type dryer described as an embodiment in order to describe the spirit of the present invention. However, it is to be noted that the spirit of the embodiments is not limited to the condensation-type dryer and is applicable even to an exhaust-type dryer.

Referring to FIG. 1, a dryer 10 according to the first embodiment of the present invention includes a cabinet 100 forming an exterior thereof and having an opening part 110 formed on a front surface thereof and a door 120 that is rotatably connected to one side of the cabinet 100 and selectively opens and closes the opening part 110.

The inside of the cabinet 100 is provided with a drum 200 (see FIG. 2) that receives a moisture containing drying target. The drying target can be input into the drum 200 through the opening part 110.

The door 120 is provided with a transparent window 121. The user can view the inside of the drum 200 to confirm the drying state in the state where the door 120 is closed.

A control unit 140 that can control a cycle of the dryer 10 is provided on one side of the cabinet 100. A display unit that displays an operation condition of the dryer and a plurality of buttons that can be operated by the user are included in the control unit 140.

A drawer 130 that stores condensed water that is generated in the drying process of the drying target is provide on the front surface of the cabinet 100. When the condensed water is stored in the drawer 130 above a predetermined level, the user can draw out the drawer 130 to drain the condensed water.

A lower cover 150 is removably provided on the front lower portion of the cabinet 100. The lower cover 150 plays a role of covering a heat exchanger 260 (see FIG. 2) cooling air that circulates in the dryer 10 so that the heat exchanger 260 is not viewed from the outside. The user separates the lower cover 150 from the cabinet 100 and thereafter, draws out the heat exchanger 260 for cleaning.

Meanwhile, a foreign material removing apparatus 300 removing the foreign materials contained in the air passing through the drum 200 is provided on the front of the drum 200. Hereinafter, the detailed configuration thereof will be described.

Figure 2:
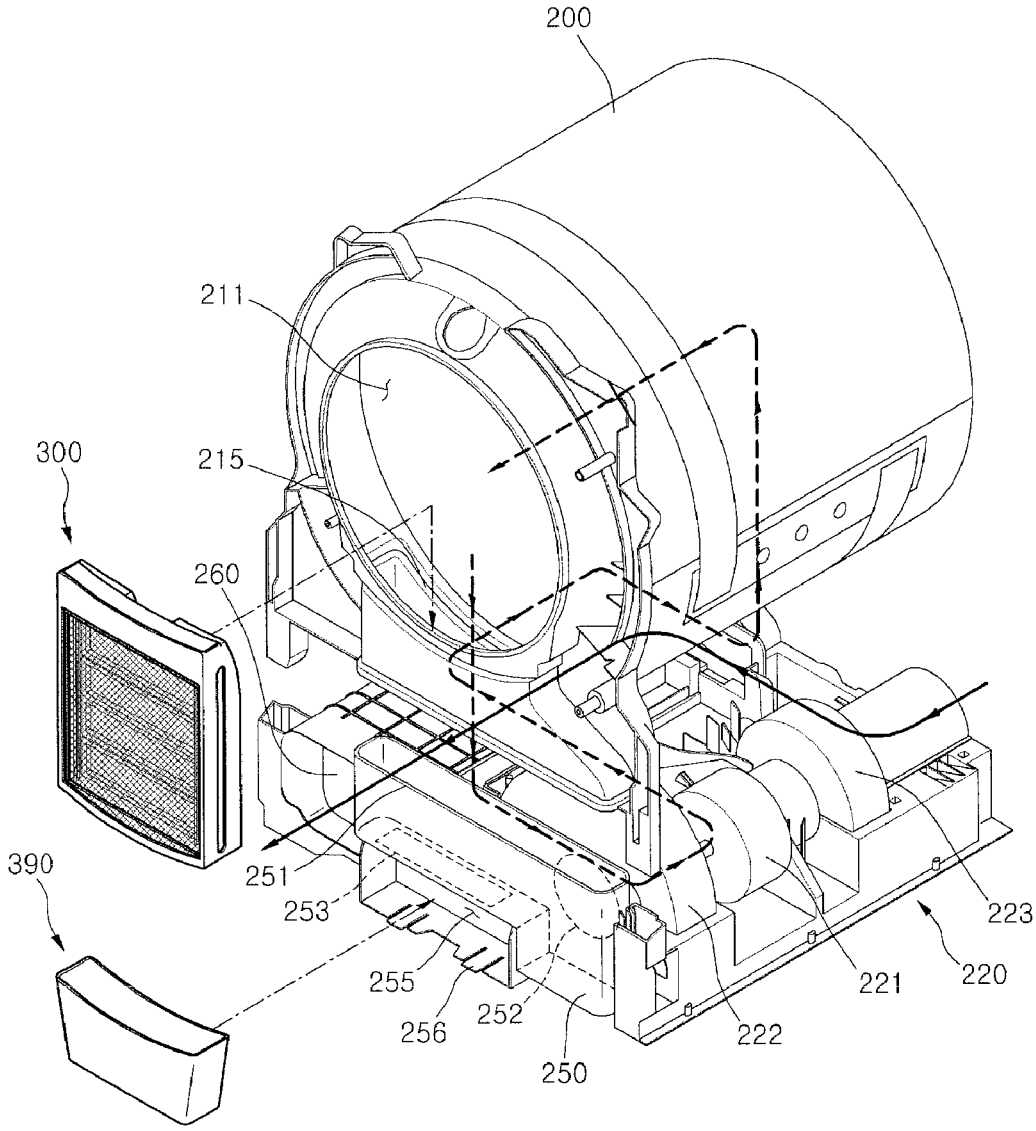
FIG. 2 is an exploded perspective view showing main internal components of a dryer according to a first embodiment of the present invention.

FIG. 2 is an exploded perspective view showing main internal components of a dryer according to the first embodiment of the present invention.

Referring to FIG. 2, the cabinet 100 includes the drum 200 housing the drying target, a drum cover 210 that is coupled to the front surface of the drum 200 to support the drum 200, a rotation motor 221 that is provided in a lower portion of the drum 200 to rotate the drum 200, a blowing fan 222 that is connected to the rotation motor 221 to circulate the air in the drum 200, and a base 220 on which the rotation motor 221 and the blowing fan 222 are mounted.

More specifically, the drum 200 has a cylindrical shape of which the front surface and the rear surface are opened and the front surface of the drum 200 is disposed to face the opening part 110. The front surface of the drum 200 is rotatably connected to the drum cover 210. A felt, etc., is provided in the drum cover 210 that is in contact with the drum 200 to allow the drum 200 to smoothly rotate.

The drum cover 210 supports the drum 200 and is coupled with the front end portion of the base 220. The drum cover 210 is formed with an input hole 211 into which the drying target is input. The input hole 211 may be punched to correspond to the opening part 110 and the front surface of the drum 200.

When the user opens the door 120 and inputs the drying target through the opening part 110, the drying target is housed in the drum 200 while passing through the input hole 211.

In addition, an air duct 215 is provided on the lower side of the input hole 211 so that air passing through the drum 200 can be circulated. The foreign material removing apparatus 300 is mounted on the air duct 215 to clean the foreign materials. A foreign material removing cover 250 is connected to the lower portion of the air duct 215. The detailed description thereof will be described.

The base 220 is configured to form the bottom surface of the dryer 10 and support the drum 210 and the drum 220.

The rotation motor 221 is provided at an approximately central portion of the base 220 and can be connected to the drum 200 by a belt member (not shown). The drum 200 can be rotated by the driving of the rotation motor 221.

The blowing fan 222 may be rotatably connected to the rotation motor 221 and may be provided at the front portion of the motor 221. A cooling fan 223 that is driven by the rotation motor 221 and sucks the external air is provided at the rear portion of the rotation motor 221. The external air sucked by the cooling fan 223 is heat-exchanged in the heat exchanger 260.

Although not shown in the drawings, a heater, which heats air introduced into the drum 200, is provided on the rear portion of the drum 200.

The heat exchanger 260 that performs the heat exchange between the air which circulates in the drum 200 and the air introduced from the outside of the dryer 10 to exchange heat is provided in one side of the base 220.

The heat exchanger 260 is provided to be drawn out and in from the front portion of the base 220 so that the user can draw out the heat exchanger 260 and clean it. The detailed operation of the heat exchanger 260 will be described below.

In addition, the foreign material removing apparatus cover 250 is removably provided on the front portion of the base 220. The foreign material removing apparatus cover 250 is provided on the lower portion of the drum cover 210 and is connected to the lower end portion of the air duct 215.

In detail, the insertion groove 251 into which the foreign material removing apparatus 300 can be inserted is formed to be depressed in the upper end portion of the foreign material removing apparatus cover 250. The insertion groove 251 is connected to the lower end portion of the air duct 215. Therefore, when the foreign material removing apparatus 300 is inserted into the air duct 215, at least a part of the foreign material removing apparatus 300 is inserted into the insertion groove 251.

The insertion groove 251 extends to the front portion of the blowing fan 222. A communicating hole 252, which moves air to the blowing fan 222, is formed in the insertion groove 251 The air, which passes through the drum 200, is introduced into the air duct 215 and can be moved to the blowing fan 222 while passing through the foreign material removing apparatus 300 and the insertion groove 251.

The foreign material case 390 in which the foreign materials are stored and a foreign material case housing part 255 to which the foreign material case 390 is removably coupled are provided on one side of the foreign material removing apparatus cover 250. The foreign materials can be input in the foreign material case 390 through the opened upper surface.

The foreign material case housing part 255 is depressed to the rear portion to correspond to the shape of the foreign material case 390. The hook 256, which is locked to the foreign material case 390, is provided on the bottom surface of the foreign material case housing part 255.

A foreign material dropping hole 253 is formed on the foreign material removing apparatus cover 250 so that the foreign materials dropping from the foreign material removing apparatus 300 can be housed in the foreign material case 390.

More specifically, a foreign material discharge hole 314 (see FIG. 3) is formed on the bottom surface of the foreign material removing apparatus 300 and the foreign material dropping hole 253 is disposed at a position corresponding to the foreign material discharge hole The foreign materials separated from the foreign material removing apparatus 300 is input to the foreign material case 390 and the foreign material case 390 while passing through the foreign material dropping hole 253.

When the foreign materials stored in the foreign material case 390 is filled at a predetermined level or more, the foreign material can be discharged by separating the foreign material case 390.

When the foreign materials stored in the foreign material case 390 is filled at a predetermined level or more, the foreign material can be discharged by separating the foreign material case 290.

In another embodiment, a part of the foreign material removing apparatus 300 can be configured to be protruded to the lower portion of the foreign material dropping hole 253. In this case, since the lower end portion of the foreign material removing apparatus 300 is housed in the foreign material case 390, the foreign materials dropping from the foreign material removing apparatus 300 can prevent the leakage to the outside.

Further, the foreign material removing apparatus cover 250 can be formed to shield the inlet and outlet of the heat exchanger 260 in order to sufficiently secure the size of the filter member 500 to be described later. In this case, the heat exchanger 260 can be drawn out after the lower cover 150 and the foreign material removing apparatus 250 are removed.

Meanwhile, since the driving to et contains a large amount of moisture, when dry hot wind passes through the drying target, the moisture contained in the drying target evaporates and spreads to the air. The evaporation process is executed at the same time when the drum 200 rotates and the drying target is dried by being rotated with the drum 200.

At this time, foreign materials such as dust, naps, etc. contained in the drying target spread to the air. The foreign materials are included in the air that passes through the drum 200. When the foreign materials are introduced into the blowing fan 222, etc., the fault of the blowing fan 220 can occur, such that the foreign materials can be filtered before passing through the blowing fan 222.

The foreign material removing apparatus 300 is mounted on the drum cover 210, such that air passing through the drum 200 can be removed from the foreign materials.

In detail, when the foreign material removing apparatus 300 is mounted to the low part from the upper portion of the air duct 215 and at least a part of the foreign material removing apparatus 300 is inserted into the insertion groove 251.

The air, which passes through the drum 200, is introduced from the upper side of the foreign material removing apparatus 300 and after the foreign material is filtered, is discharged to the front portion of the foreign material removing apparatus 300. At this time, the front portion of the foreign material removing apparatus 300 can be disposed to be spaced from the drum cover 210 and the inner side surface of the insertion groove 251 so that air smoothly flows in the drum cover 210 and the insertion groove 251.

The operation of the dryer 10 having the above-mentioned configuration will be described below.

The dryer 10 is a condensation-type dryer and is operated in a scheme that the air (a dotted line arrow of FIG. 2, hereinafter, circulation air) circulating in the dryer 10 is cooled by the air (a solid line arrow of FIG. 2, hereinafter, cooling air) introduced from the outside of the dryer 10.

In detail, the circulation air in the drum 200 includes a large quantity of moisture containing foreign materials. The circulation air moves forward by the rotation of the blowing fan 222 and is discharged from the drum 200 and passes through the foreign material removing apparatus 300. In this process, the foreign materials included in the circulation air are filtered by the filter member 500 to be described later.

The circulation air, which passes through the foreign material removing apparatus 30, moves to the heat exchanger 260 through the blowing fan 22 and can be cooled by being heat-exchanged with the cooling air. In the heat exchange process, the condensed water, which is condensed from the circulation air, moves to the drawer 130 and is discharged.

The cooled circulation air moves to the rear portion of the base 220 and is heated at high temperature by the heater. The heated air is introduced into the drum 200 again and circulates in the dryer 10.

Meanwhile, the cooling air is sucked into the base 220 from the rear portion of the drier 10 by the rotation of the cooling fan 223. The cooling air moves to the heat exchanger 260 along the passage formed in the base 220 and can be heat-exchanged with the circulation air. The cooling air with an increased temperature in the heat exchange process is discharged to the front or side of the drier 10.

Hereinafter, the configuration and operation of the foreign material removing apparatus 300 will be described with reference to the drawings.

Figure 3:
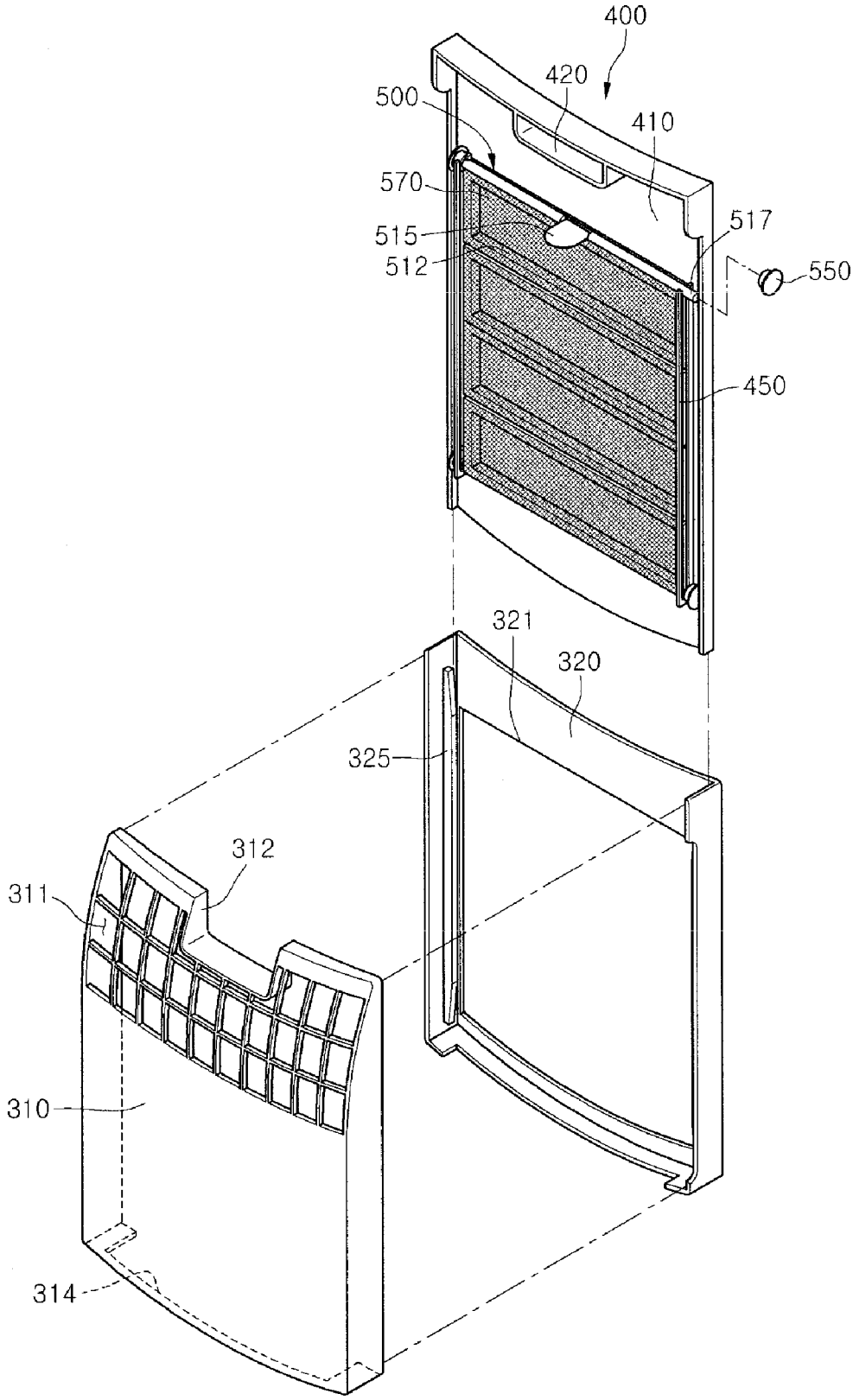
FIG. 3 is an exploded perspective view showing components of a foreign material removing apparatus of FIG. 2.
Figure 4:
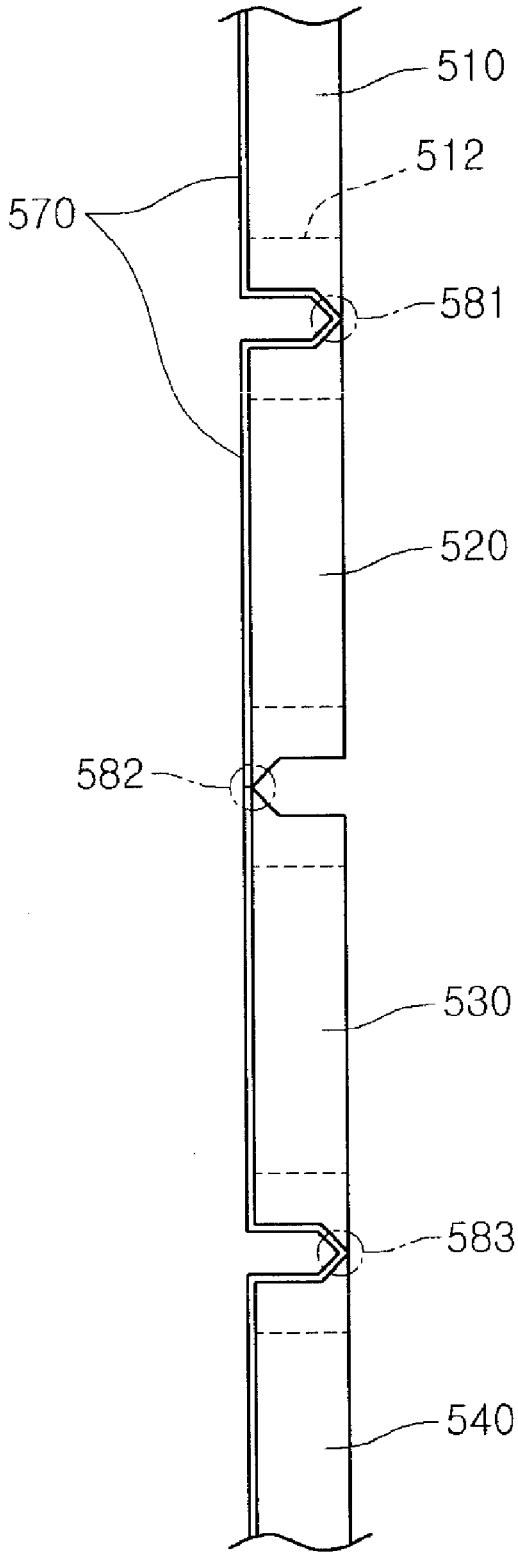
FIG. 4 is a side view showing a curved part of a filter member of FIG. 3.
Figure 5:
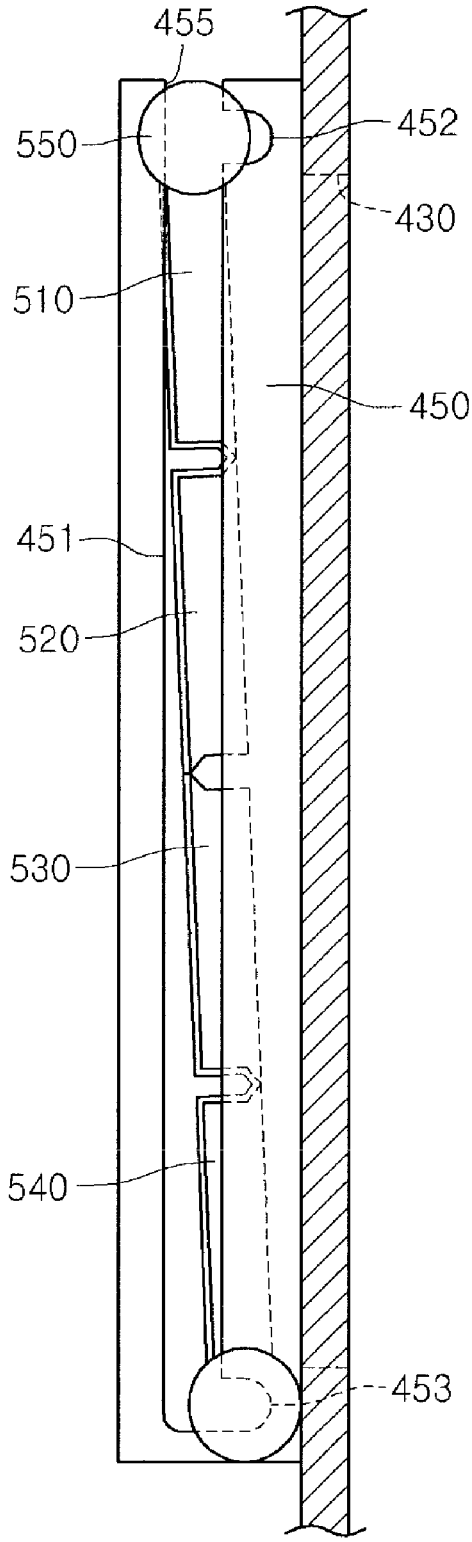
FIG. 5 is a side view showing an appearance before the filter member of FIG. 3 is curved.
Figure 6:
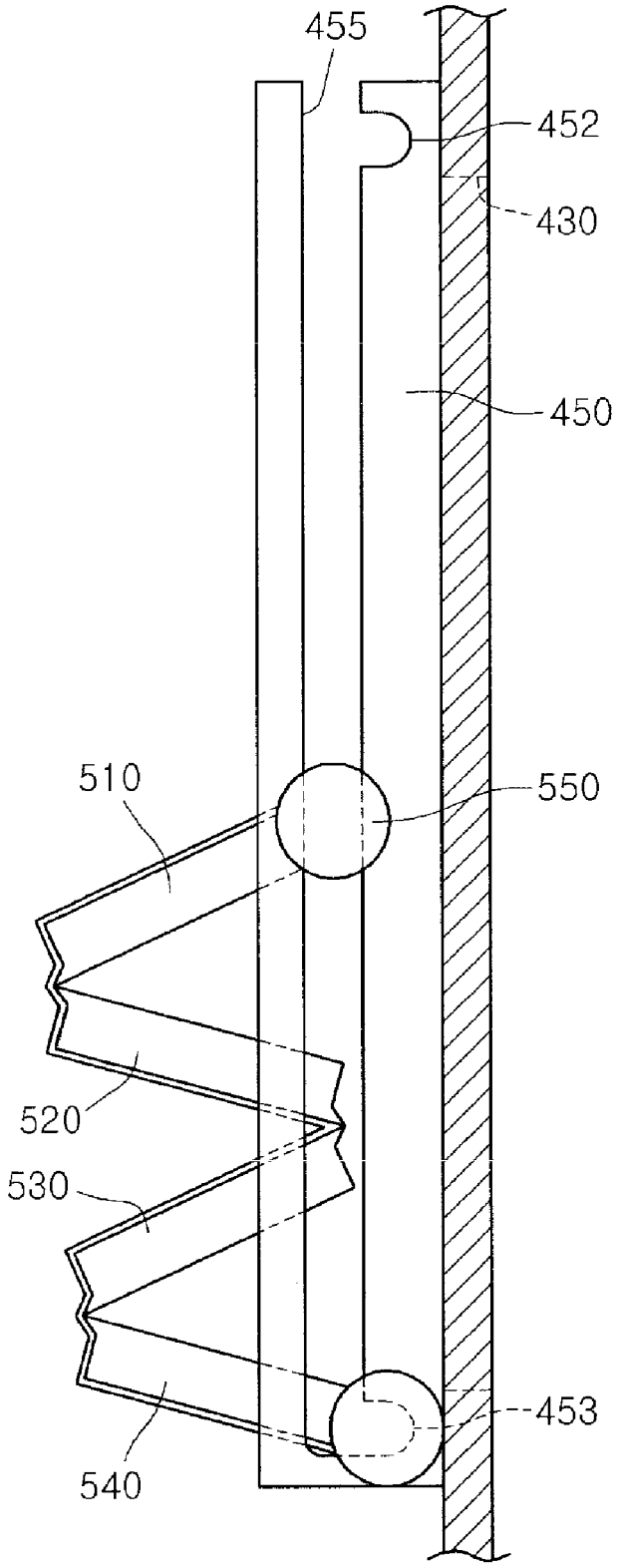
FIG. 6 is a side view showing an appearance after the filter member of FIG. 3 is curved.

FIG. 3 is an exploded perspective view showing components of a foreign material removing apparatus of FIG. 2, FIG. 4 is a side view showing a curved part of a filter member of FIG. 3, FIG. 5 is a side view showing an appearance before the filter member of FIG. 3 is curved, and FIG. 6 is a side view showing an appearance after the filter member of FIG. 3 is curved.

Referring to FIG. 3 to 6, the foreign material removing apparatus 300 includes a first case 310 in which an air introduction hole 311 is formed, a second case 320 in which an air discharge hole 321 is formed, and a filtering unit 400 that is provided in a space between the first case 310 and the second case 320 and filters the foreign materials in the air introduced through the air introduction hole 311.

However, the first case 310 and the second case 320 may be integrally injection-molded. Unlike one shown in the drawings, the air introduction hole 311 may be formed in the second case 320 and the air discharge hole 321 may be formed in the first case 310.

The first case 310 faces the rear portion of the dryer 10 and the second case 320 is inserted to face the front portion of the dryer 10, in the state where the foreign material removing apparatus 300 is inserted into the drum cover 210.

In other words, the first case 310 is disposed to face the rear portion of the dryer 10 so that it faces the drum 200 and the air discharged from the drum 200 may be introduced into the air introduction hole 311 through the air duct 215.

In detail, the air introduction hole 311 is a part into which air discharged from the drum 200 is introduced and is formed on the upper part of the first case 310 to be tilted at a predetermined angle. The air discharged from the drum 200 may be input at an acute angle with respect to a horizontal surface. The air introduction hole 311 is provided in a grill shape, such that it can prevent the drying target from inputting to the inside of the foreign material removing apparatus 300.

In detail, the air introduction hole 311 is a part into which air discharged from the drum 200 is introduced and is formed on the upper par of the first case 310 to be tilted at a predetermined angle. The air discharged from the drum 200 may be input at an acute angle with respect to a horizontal surface. The air introduction hole 311 is provided in a grill shape, such that it can prevent the drying target from inputting to the inside of the foreign material removing apparatus 300.

Since the air introduction hole 311 is provided to be tilted, the air discharged from the drum 200 flows while forming a predetermined angle with respect to the filtering unit 400.

The foreign material discharge hole 314, which separates the foreign materials from the filtering unit 400 and is discharged, is formed on the bottom surface of the first case 310. The foreign material discharge hole 314 is positioned at the front side of the surface that filters the foreign materials of the filtering unit 400, such that it is formed to smoothly discharge the separated foreign materials.

A handle groove 312 may be formed on the upper end portion of the first case 310 so that the user can easily hold a removable handle 420 of the filtering unit 400.

The air discharge hole 321, which discharges air passing through the filtering unit 400, is formed in the second case 320. The air discharge hole 321 is formed in an approximately rectangular shape and is formed at a sufficient size so that the wind quantity, which circulates in the dryer 10, can be secured above a predetermined level.

In addition, a guide rib 325, which guides the coupling of the filtering unit 400, is provided at both sides of the second case 320. The filtering unit 400 may be inserted downwardly to face a space between the second case 320 and the guide rib 325.

The guide rib 325 supports the front portion of the filtering unit 400 in the state where the filtering unit 400 is coupled thereto and the filtering unit 400 can be closed to the second case 320.

In the state where the filtering unit 400 is coupled to one side of the guide rib 325, the air discharge hole 321 can be shielded. The air introduced through the air introduction hole 311 can pass through the filtering unit 400 and be discharged to the air discharge hole 321. The foreign materials discharged through the foreign material discharge hole 314 can be stored in the foreign material case 390.

The filtering unit 400 includes, a filter case 410, an air hole 430 that is formed in the filter case 410 in a punched form and is formed to correspond to the shape of the air discharge hole 321, a filter member 500 that is formed to shield the air hole 430 and filters the foreign materials, and a guide part 450 that guides the curve of the filter member 500.

In detail, the filter case 410 is configured to be inserted into the second case 320.

A removable handle 420 is provided on the upper end portion of the filter case 410 so that the user can easily hold the filter case 410 to separate the filtering unit 400 from the foreign material removing apparatus 300. The removable handle 420 may be disposed at a position corresponding to the removable handle groove 312 when the filter case 410 is coupled with the second case 320.

The filter case 410 includes the air hole 430 that is formed at a position corresponding to the air discharge hole 321 when the filter case 410 is coupled with the second case 320. The air hole 430 is shielded by the filter member 500 and the air passing through the filter member 500 moves to the air discharge hole 321 through the air hole 430.

The guide part 450, which guides the curve of the filter member 500, extends up and down at both sides of the air hole 430. The up and down direction may be a direction that is defined corresponding to the configuration that the filter member 500 moves (folds) up and down.

In detail, the guide part 450 is formed to be protruded by a predetermined length from the filter case 410. The guide part 450 is formed with a guide groove 451 that is depressed downwardly. The upper end portion of the guide groove 451 is formed with the insertion part 455 opened so that the filter member 500 can be inserted. The filter member 500 is inserted to the lower portion from the upper portion of the insertion part 455.

The guide groove 451 extends from the lower portion of the insertion part 455 to the lower end portion of the guide part 450 and the filter member 500 may be inserted up to the lower end portion of the guide part 450 along the guide groove 451. At this time, the guide groove 451 is formed at a position spaced by a predetermined distance from the filter case 410 so that the filter member 500 is closely coupled to the filter case 410.

The upper end portion and lower end portion of the guide groove 451 are formed with an upper hooking groove 452 and a lower hooking groove 453, respectively, so that they are disposed to be intersected with the extending direction of the guide groove 451. The upper end portion and lower end portion of the filter member 500 can be inserted into the hooking grooves 452 and 453, respectively, such that the filter member 450 may be maintained in an unfolded state.

Meanwhile, the filter member 500 is formed so that the plurality of parts are relatively curved to each other. At this time, it is preferable that the parts are provided in an even number so that the filter member 500 can be curved the state where the filter member 500 is coupled with the guide part 450. In the embodiment, the case where the filter member 500 is configured in four parts will be described by way of example.

The filter member 500 includes a first part 510 that is provided on the uppermost side, a second part 520 that is connected to the lower portion of the first part 510, a third part 530 that is connected to the lower portion of the second part 520, and a fourth part 540 that is connected to the third part 530 and is provided on the lowermost side.

Each of the first, second, third, and fourth parts 510, 520, 530, and 540 can be configured by one that the filter 570 is attached to the frame 512. The frame 512 has an approximately rectangular shape and the central portion of the frame 512 is punched. The filter 570 is configured to filter the foreign materials.

At this time, the filter 570 is formed so that all the filters provided to each of the part 510, 520, 530, and 540 can be connected, thereby better separating the foreign materials. The detailed contents thereof will be described below.

A fixing projection 517, which moves up and down while being inserted into the guide groove 451, is formed at both sides of the upper end portion of the first part 510 and the lower end portion of the fourth part. The fixing projection 517 may extend to the outer side of the guide part 450.

The fixing projection 517 is coupled to a fixing member 550. The fixing member 550 is coupled at both sides of the first part 510 and the fourth part 540 and the filter member 500 can be coupled to the filter case 410 by the fixing member 550. The filter member 500 is fixed to the guide part 450 by inserting the fixing projection 517 into the hooking grooves 452 and 453.

A filter handle 515 is provided on the upper end portion of the first part 510. The filter handle 515 is coupled to the upper end portion of the first part 510 by a hinge and can be configured to be rotated according to the degree of pulling the filter handle 515 by the user.

Meanwhile, each part 510, 520, 530, and 540 is connected to each other by curved parts 581, 582, and 583.

The curved parts, which are formed on the upper side and the lower portion of one of the parts 510, 520, 530, and 540, are disposed not to be positioned on the same line in a vertical direction. Therefore, when the user holds the filter handle 515 and pulls it down, the filter member 500 is folded as becoming wrinkled and in this process, the foreign materials that are filtered in the filter member 500 can be removed.

In detail, the rear edge of the lower end portion of the first part 510 is protruded downwardly by a predetermined length, such that it is connected to a portion protruded by a predetermined length from the rear edge of the upper end portion of the second part 520. The connection portion can be thinly formed to be folded.

At this time, the connection portion forms the first curved part 581. Since the first curved part 581 is provided at the rear portions of the first and second parts 510 and 520, the first part 510 can be relatively rotated clockwise with respect to the second part 520 based on the first curved part 581 (see FIG. 6).

The front edge of the lower end portion of the second part 520 is protruded by a predetermined length downwardly, such that it is connected to the portion protruded by a predetermined length from the front edge of the upper end portion of the third part 530.

At this time, the connection portion forms the second curved part 582. Since the second curved part 582 is provided at the front portions of the first and second parts 520 and 530, the second part 510 can be relatively rotated counterclockwise with respect to the third part 530 based on the second curved part 582 (see FIG. 6).

In summary, the first curved part 581 is disposed to face the rear portion of the second part 520 and the second curved part 582 is disposed to face the front portion of the second part 520. In other words, the first curved part 581 and the second curved part 582 are disposed to face each other. The first part 510 may be rotated clockwise by the arrangement and the second part 510 may be rotated counterclockwise.

The configuration of the third curved part 583 between the third part 530 and the fourth part 540 is similar to the configuration of the first curved part 581 and the third part 530 can be relatively rotated clockwise with respect to the fourth part 540 based on the third curved part 583 (see FIG. 6). Similarly, the second curved part 582 and the third curved part 583 are disposed to face each other.

The above-mentioned curved part is alternately disposed in a front and rear direction of each part 510, 520, 530, and 540, such that each part 510, 520, 530, and 540 is sequentially rotated in different directions (clockwise or counterclockwise direction). Consequently, the filter member 500 is operated to be folded as becoming wrinkled while each part 510, 520, 530, and 540 are rotated.

Consequently, the length of the filter member 500 in the folded state is formed to be smaller than the filter member 500 in the unfolded state. In the embodiment, when the filter member 500 is folded up and down, the length of the up and down direction of the filter member 500 can be reduced during the folding process. On the other hand, in embodiments as will be described later, when the filter member 500 is folded left and right, the length of the left and right direction of the filter member 500 can be reduced during the folding process.

At this time, since the fixing projection 517 moves in the state where it is inserted into the guide groove 451, the filter member 500 can be folded only in a predetermined direction. In addition, since the filter member 500 is folded in the state where it is coupled with the filter case 410, the user can conveniently clean the filter member 500.

Meanwhile, adjacent filters of each of the part 510, 520, 530, and 540 are closely disposed in the state where the filter member 500 is unfolded. In other words, the filter, which is provided in one part and the filter, which is provided in the adjacent part are closely formed, such that a filter, which is substantially plane to the filter member 500, can be obtained.

For example, the filter 570 can be attached to extend to the adjacent parts while passing through the curved parts 581, 582, and 583 from the front surface of each part 510, 520, 530, and 540.

The function and operation of the filter member 500 will be described below.

The air introduced through the air introduction hole 311 passes through the filtering unit 400 and is discharged to the air discharge hole 321. In this process, the foreign materials included in the air are filtered in the filtering unit 400.

Air necessarily passes through the filter member 500 in the state where the filter member 500 and the air hole 430 are shielded, such that the foreign materials can be easily filtered by the filter 570.

The filters 570 attached to each part 510, 520, 530, and 540 are closely formed to each other, such that the foreign materials can be filtered at boundary portions of each part 510, 520, 530, and 540.

Meanwhile, at the early state of the drying cycle, the foreign materials are collected in the filter surface of the filter member 500 together with moisture while a large quantity of moisture containing air is filtered. Thereafter, when air, which is gradually dried according to the progress of the drying cycle, passes through the filter member 500, a coagulation phenomenon that the collected foreign materials are firmly adhered to the filter member can occur. In particular, the foreign materials may be adhered to the curved parts 581, 582, and 583.

After the drying cycle is terminated, the user separates the filtering unit 400 from the foreign material removing apparatus 300. The user can open the door 120 and separate the filtering unit 400 by using the removable handle 420 that is exposed to the outside.

After the filtering unit 400 is separated, the user pulls the filter handle 515 forward, such that the fixing projection 517 of the first part 510 is separated from the upper hooking groove 452. Thereafter, when the user pulls the filter handle 515 downward, the filter member 500 becomes wrinkled by being curved based on the curved parts 581, 582, and 583.

When the filter member 500 becomes wrinkled, the adhered foreign materials can be separated from the filter member 500 based on the position corresponding to the curved parts 581, 582, and 583. If necessary, the folding operation to wrinkle the filter member 500 can be repeatedly performed as described above.

Pieces of the separated foreign materials are stored in the foreign case 390 and the user removes the foreign materials of the foreign case 390, such that the cleaning of the filtering unit 400 can be finished.

Consequently, the hardened foreign materials are separated from the filter member 500 and can be cleaned by the operation of pulling the filter handle 515 by the user, thereby making it possible to increase the convenience of use.

Hereinafter, a dryer according to the second embodiment of the present invention will be described with reference to the drawings. However, since the second embodiment has the difference in the direction that the filter is folded as compared to comparing the first embodiment, the difference will mainly be described and the same components thereof recites the description and reference numerals of the first embodiment.

Figure 7:
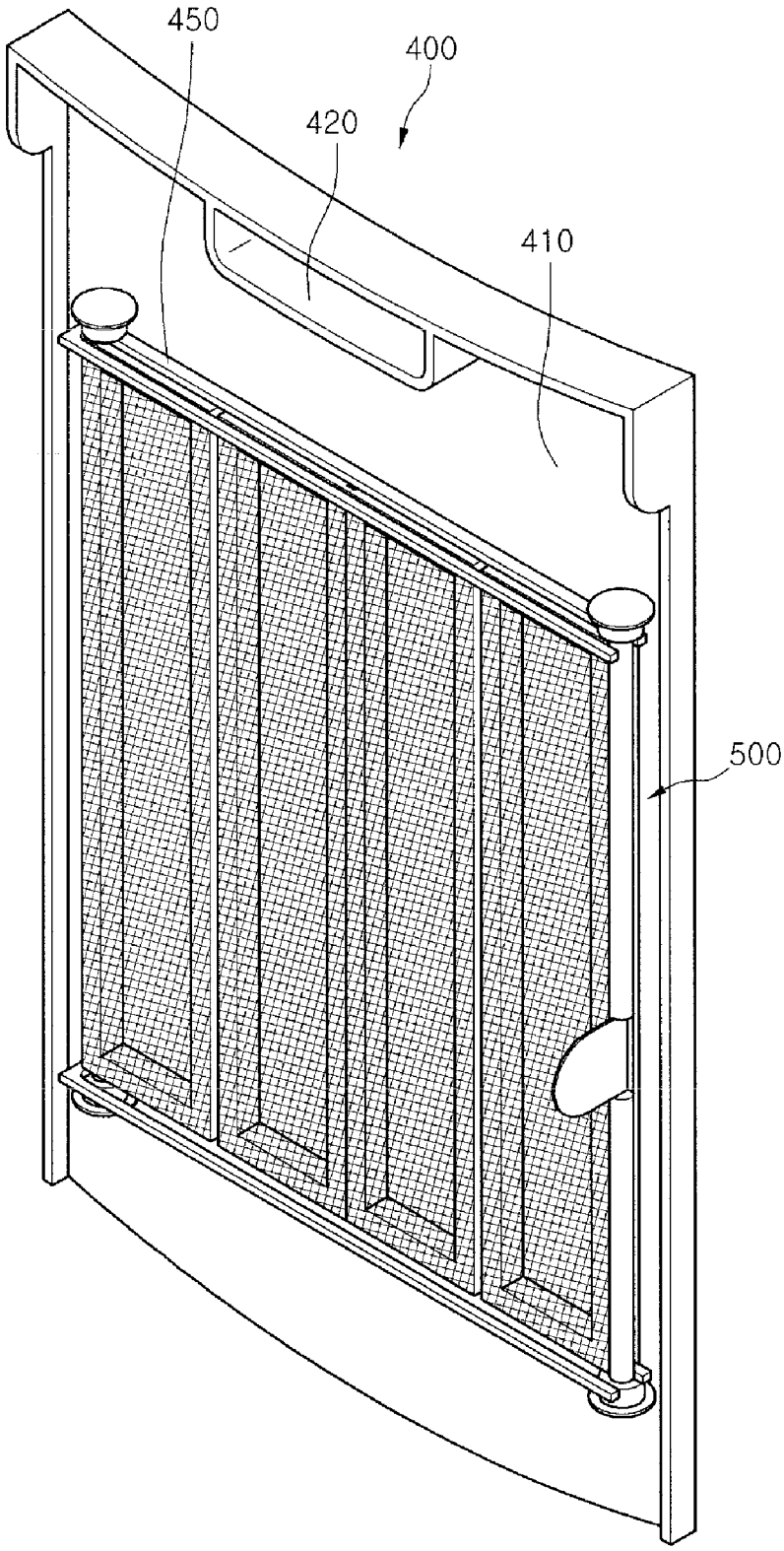
FIG. 7 is a perspective view showing a filter member of a dryer according to a second embodiment of the present invention.

FIG. 7 is a perspective view showing a filter member of a dryer according to a second embodiment of the present invention.

Referring to FIG. 7, the guide unit 450 is formed on the upper portion and lower portion of the air hole 430 to extend in a left and right direction.

The left and right portions of the guide part 450 are provided with the insertion part 455 in which the filter member 500 is inserted and the guide groove 451 that extends to a horizontal direction from the insertion part 455. One end portion and the other end portion of the guide groove 451 are each formed with the hooking grooves 452 and 453.

The filter member 500 is inserted into the insertion part 455 in a horizontal direction and the fixing projection 517 is inserted into the hooking groove 452, such that the filter member is fixed to the filter case 410. The user holds the filter handle 515 and applies force thereto to pull it in a horizontal direction, such that the coagulated foreign materials adhered to the filter member can be broken and removed.

In this case, since the curved parts 581, 582, and 583 lengthily extend up and down and the filter member 500 is folded to be wrinkled in a left and right direction, the foreign materials separated from the surface of the filter 270 is easy to drop in a down direction that is a gravity direction. That is, the foreign materials can be better separated from the surface of the filter 270.

In summary, the filter member 500 of the first embodiment is inserted into the filtering unit 400 up and down (vertically) and thus, is disposed to be folded up and down, while the filter member 500 according to the embodiment is inserted into the filtering unit 400 in a left and right (horizontal) direction and thus is disposed to be folded left and down.

Hereinafter, a dryer according to a third embodiment of the present invention will be described with reference to the drawings. However, since the third embodiment has difference in a configuration that the filter is automatically folded as compared to comparing the first embodiment, the difference will mainly be described and the same components thereof recites the description and reference numerals of the first embodiment.

Figure 8:
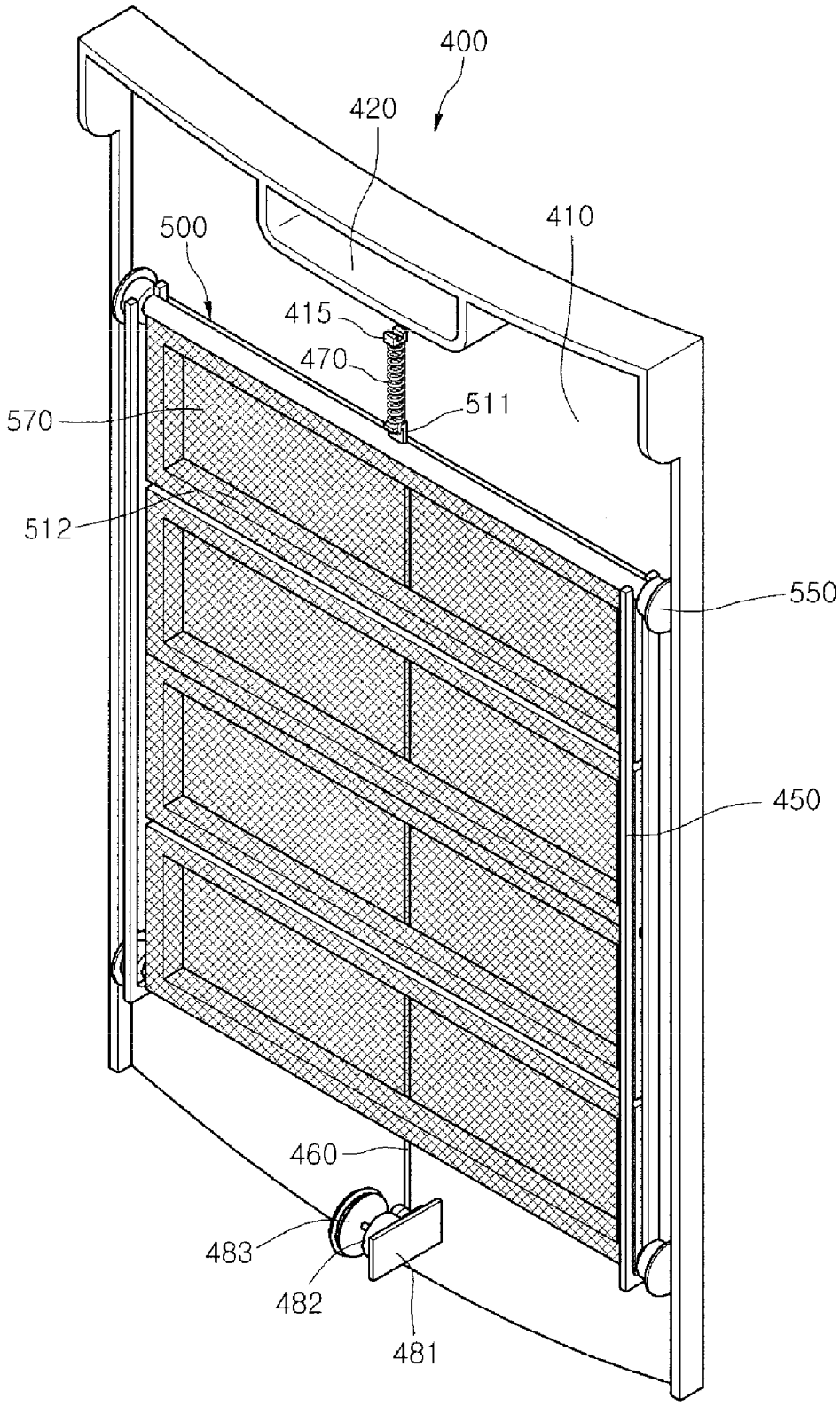
FIG. 8 is a perspective view showing a filter member of a dryer according to a third embodiment of the present invention.
Figure 9:
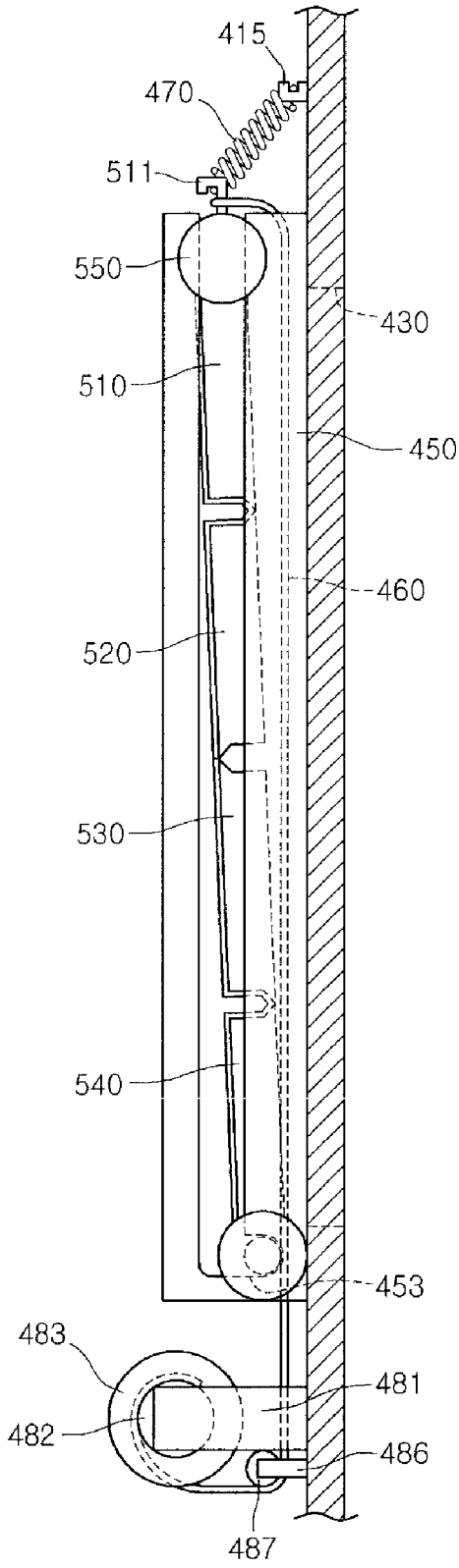
FIG. 9 is a side view showing an appearance before the filter member of FIG. 8 is curved.
Figure 10:
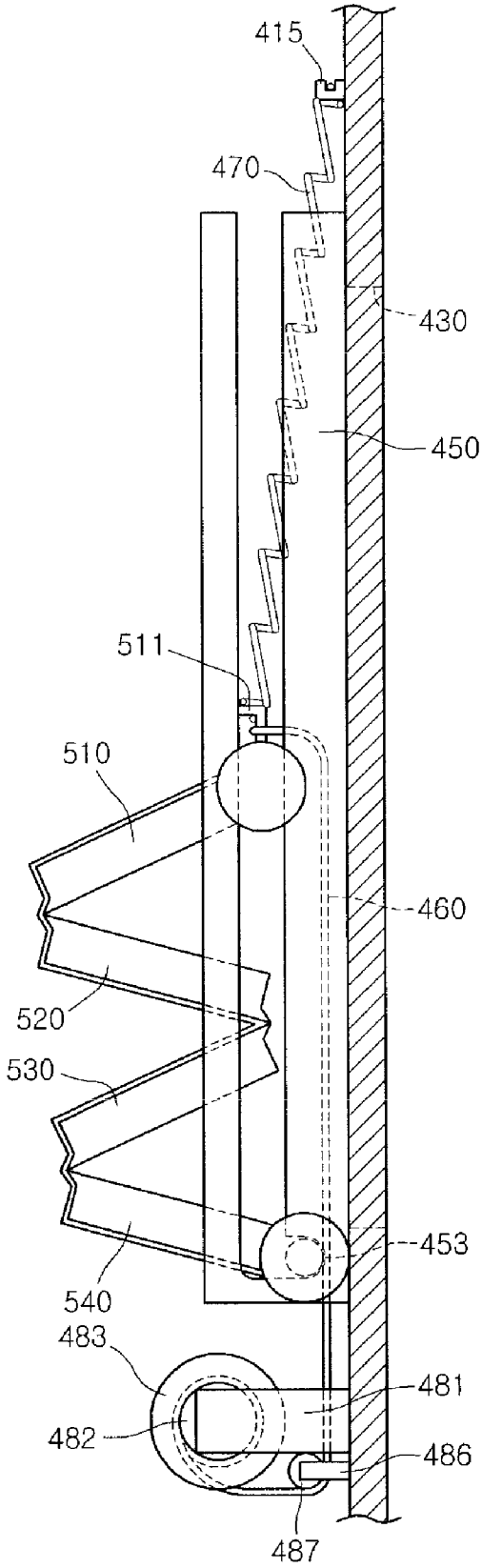
FIG. 10 is a side view showing an appearance after the filter member of FIG. 8 is curved.

FIG. 8 is a perspective view showing a filter member of a dryer according to a third embodiment of the present invention, FIG. 9 is a side view showing an appearance before the filter member of FIG. 8 is curved, and FIG. 10 is a side view showing an appearance after the filter member of FIG. 8 is curved.

Referring to FIG. 8 to 10, a driving unit 480 is provided on the lower portion of the air hole 430 so that the filter member 500 can be automatically folded.

In detail, the driving unit 480 includes a driving motor 482, a motor supporting part 481 that is protruded from the filter case 410 and supports the driving motor 482, and a pulley 483 that is connected to the rotation shaft of the driving motor 482. The driving motor 482 may be disposed so that the pulley 483 is positioned in a vertical direction of the filter case 410.

The pulley 483 is connected to a wire 460. The wire 460 is fixed to the upper end portion of the first part 510 while passing through the space between the filter member 500 and the filter case 410. The pulley 483 and the wire 460 can be considered as a "power transfer unit" that transfers the driving force of the driving motor 482 to the filter member 500.

In detail, the upper end portion of the first part 510 is provided with a hooking part 511 that is protruded from the first part 510 and is curved at least once. The wire 460 may be hooked to the hooking part 511.

The filter case 410 is provided with a direction changing pulley 487 that changes the direction of the wire. The direction changing pulley 487 is disposed to be spaced by a predetermined distance from the filter case 410 so that the wire 460 extended from the pulley 483 can pass through the space between the filter member 570 and the filter case 410 without interfering with the filter member 570, etc. The direction changing pulley 487 may be fixed to the filter case 410 by the pulley supporting part 486.

The filter member 500 may be folded by the driving of the driving motor 482.

In detail, when the pulley 483 is rotated, the wire 460 is wound on the pulley 483. Therefore, a downwardly pulled force is applied to the first part 510 and in this process, the filter member 500 is folded. At this time, since the fixing projection 517 drops along the guide groove 451 and the filter member 500 can be folded in a predetermined direction.

Meanwhile, the upper part of the filter member 500 is provided with an elastic member 470 that returns the filter member to an original state from the state where the filter member 500 is folded. The elastic member 470 includes a tension spring. However, the elastic member 470 is not limited to the tension spring and other elastic body, which provides a restoring force, can be used. The embodiment will describe the tension spring by way of example.

In detail, the elastic member 470 is fixed to the fixing part 415 whose one side is fixed to the hooking part 511 and the other side is formed on the upper side of the filter case 410.

The elastic member 470 is in the state where the external force is not applied when the filter member 500 is unfolded, that is, the state where the elastic deformation does not occur.

On the other hand, when the filter member 500 is folded, the elastic member 470 is extended and applies the restoring force upward. The size of the restoring force is proportional to the degree that the elastic member 470 is folded by a Hook's law.

When the filter member 500 is folded and thus, the coagulated foreign materials reach a separated state, the operation of the driving motor 482 stops. The operation time of the driving motor 482 can be previously set.

When the operation of the driving motor 482 stops, the filter member 500 is unfolded in an original state by the restoring force of the elastic member 470. In this process, the pulley 483 is rotated in an opposite direction when the filter member 500 is folded and the wire 460 is released.

As described above, when the operation of the driving motor 482 and the restoring process by the elastic member 470 are repeated, the foreign materials adhered to the filter member 500 can be better separated and discharged.

The foreign materials separated from the filter member 500 are stored in the foreign material case 390 through the foreign material discharge hole 314 by the above-mentioned process.

When the foreign materials are stored in the foreign case 390 above a predetermined level, the user separates only the foreign material case 390 and throws out the foreign materials and then mounts the foreign material case 390 again.

Since the foreign materials are automatically cleaned, the foreign materials are not accumulated in the filter 570 and thus, the wind quantity in the dryer 10 can be always maintained at a proper level or more. At this time, the above-mentioned process of cleaning foreign materials can be performed at the time point when the foreign materials is completely coagulated to be easily broken, that is, at the time point when the drying cycle is terminated or after the drying cycle is terminated.

With the foreign material removing apparatus 300 having the above-mentioned configuration, the convenience of use is maximized since the user does not need to clean the filter each time the drying operation is performed.

Further, the product image is luxurious and the satisfaction of user is increased since the foreign materials are automatically removed.

In addition, since the user separates only the foreign material case 390 and throws out the foreign materials therein, he and she can conveniently use the drier 10.

Moreover, since the wind quantity passing through the inside of the drum is maintained at a predetermined level or more by automatically performing the process of removing the foreign materials, there is no risk of firing.

What is claimed is:

1. A dryer, comprising:

a cabinet that forms an exterior thereof;

a drum provided in the cabinet and configured to house a drying target;

a base having a rotation motor that rotates the drum and a blowing fan that moves air in the drum;

a drum cover coupled to the base, that supports the drum;

a case configured to be mounted on the drum cover, the case having an air introduction hole into which sir discharged from the drum is introduced and an sir discharge hole that discharges air from which foreign materials are removed; and a filter device that is separately mounted on the case and filters the foreign materials in the air introduced through the air introduction hole, wherein the filter device includes a filter member in which a plurality of parts configured to be folded based on at least one curved part is provided, and a guide part that guides a folding operation of the filter member and extends along a movement direction of the filter member, and wherein the guide part includes:

an insertion part into which the filter member is inserted;

a guide groove that extends along a folding direction of the filter member from the insertion part; and at least one hooking groove that extends in a direction that intersects with the extending direction of the guide groove and fixes the filter member.

2. The dryer according to claim 1, wherein the at least one curved part comprises a plurality of curved parts, and wherein the plurality of parts is rotatably provided clockwise and counterclockwise based on the at least one curved part.

3. The dryer according to claim 1, wherein the filter device further includes an air hole that corresponds to the air discharge hole, and wherein the filter member is disposed to shield the air hole.

4. The dryer according to claim 1, wherein the filter member further includes at least one fixing projection that is hooked to the at least one hooking groove in a state in which the filter member is unfolded, and wherein the at least one fixing projection is movably provided along the guide groove.

5. The dryer according to claim 1, wherein the at least one curved part includes:

a first curved part foldably provided between a first part of the plurality of parts and a second part of the plurality of parts; and a second curved part foldably provided between the second part of the plurality of parts and a third part of the plurality of parts, wherein the first curved part and the second curved part extend in a direction so as to face each other.

6. The dryer according to claim 1, wherein the insertion part is configured so that the filter member is coupled up and down, and the filter member is folded up and down.

7. The dryer according to claim 1, wherein the insertion part is configured so that the filter member is coupled left and right, and the filter member is folded left and right.

8. The dryer according to claim 1, further comprising:

a driving motor that provides a driving force so as to perform the folding operation of the filter member; and a power transfer device that transfers the driving force of the driving motor to the filter member.

9. The dryer according to claim 1, further comprising:

a foreign material case provided at a lower part of the filter device, that stores foreign materials separated in the folding operation of the filter member.

10. The dryer according to claim 1, wherein the case includes a first case in which the air introduction hole is formed and a second case in which the air discharge hole is formed, and wherein the filter device is provided in a space between the first case and the second case.

11. The dryer according to claim 10, wherein the first case and the second case are integrally injection molded.

12. The dryer according to claim 10, wherein a guide rib is provided at both sides of the second case, that guides the filter device when the filter device is inserted downward in the space between the first case and the second case.

13. The dryer according to claim 1, wherein the case includes a handle groove corresponding to a handle of the filter device.

14. The dryer according to claim 1, wherein the filter device includes a filter case having an air hole that corresponds to the air discharge hole of the case.

15. The dryer according to claim 1, wherein the filter device includes a frame to which the plurality of parts is attached.

16. The dryer according to claim 15, wherein the frame is approximately rectangular in shape.

17. The dryer according to claim 1, wherein the at least one hooking groove comprises a hooking groove provided at each end of the guide groove configured to mate with a fixing projection provided at each end of the filter member.

18. A dryer, comprising:

a drum that houses a drying target;

a base configured to be provided on one side of the drum, the base including a rotation motor that rotates the drum and a blowing fan that moves air;

a foreign material removing apparatus that filters foreign materials from air moved by operation of the blowing fan and cleans the filtered foreign materials; and a foreign material case provided on one side of the foreign material removing apparatus, that stores the foreign materials cleaned in the foreign material removing apparatus, wherein the foreign material removing apparatus includes:

a filter member that separates the foreign materials from the air and performs a folding movement;

a filter case that movably supports the filter member;

an open top formed in the filter case to allow the filter member to be inserted into the filter case;

a guide groove provided on one side of the filter case, that guides the folding movement of the filter member; and a fixing member provided at both upper and lower ends of the filter member, wherein the fixing member provided at the upper end of the filter member is configured to move from the open top downward along the guide groove when the filter member performs the folding movement.

19. The dryer according to claim 18, wherein the filter member includes a plurality of parts connected by at least one curved part, and wherein the plurality of parts is rotated clockwise or counterclockwise based on the curved part.

20. The dryer according to claim 19, wherein the curved part comprises a plurality of curved parts, and wherein one of the plurality of curved parts is disposed to face each other with respect to an adjacent curved part of the plurality of curved parts.

* * * * *